United States Patent [19]
Miller
[11] 4,317,643
[45] Mar. 2, 1982

[54] STEEL REINFORCED CONCRETE PILES

[76] Inventor: Donald S. Miller, 406 Janneys La., Alexandria, Va. 22302

[21] Appl. No.: 94,173

[22] Filed: Nov. 14, 1979

[51] Int. Cl.[3] ..... E02D 5/34; E04B 1/16

[52] U.S. Cl. ..... 405/256; 52/99; 52/722; 405/239

[58] Field of Search ..... 52/256, 257, 239, 733, 52/735–740, 98, 99, 722; 405/256, 239, 232

[56] References Cited

U.S. PATENT DOCUMENTS

| | | | |
|---|---|---|---|
| 812,223 | 2/1906 | Mouchel . | |
| 906,479 | 12/1908 | Witacre | 52/733 |
| 942,653 | 12/1909 | Louque | 405/256 |
| 1,165,134 | 12/1915 | Schlueter . | |
| 1,257,835 | 2/1918 | Ferguson . | |
| 1,296,628 | 3/1919 | Cooney | 405/239 |
| 2,355,190 | 8/1944 | Upson . | |
| 3,138,899 | 6/1964 | Hadley | 52/334 |
| 3,501,920 | 3/1970 | Uchiyama . | |
| 3,846,085 | 11/1974 | Dunn | 52/740 |
| 4,018,055 | 4/1977 | Leclerq | 52/740 |

OTHER PUBLICATIONS

"Standard Handbook for Mechanical Engineers'-'-Baumeister, Ed.-7th Ed.-McGraw-Hill pub.,-NYC (pp. 8-226, 12-60 to 12-82).

"Bar Supports for Reinforcing Steel", Gateway Building Products, Chicago-Price List BAR-378 (1978).

*Primary Examiner*—John E. Murtagh
*Attorney, Agent, or Firm*—Mark A. Greenfield

[57] ABSTRACT

This invention relates to a reinforced concrete pile having a plurality of steel reinforcing cables and at least one ferrous metal alloy electrically conductive rod per cable which permits severing by oxygen cutting or electric arc welding.

7 Claims, 6 Drawing Figures

STEEL REINFORCED CONCRETE PILES

BACKGROUND OF THE INVENTION

1. Field of the Invention

This invention relates to improved reinforced concrete piles which are more easily severed than conventional piles.

2. Description of the Prior Art

Where satisfactory bearing soil is not present at a reasonable depth, and the open-caisson method is for any reason impracticable, foundation piles are often used. Wood piles are subject to destruction by various causes. Concrete piles are less destructible and, hence, are adapted to many conditions. While a wood pile is usually designed to carry 15 to 20 tons per pile, a concrete pile is capable of carrying 25 to 60 tons.

Piles may be driven by the drop hammer or steam hammer methods. The steam hammer, with its comparatively light blows delivered in rapid succession, is of advantage in a plastic soil, the speed with which the blows are delivered acting to prevent the readjustment of the soil. It is also of advantage in soft soils where the driving is easy, but a light hammer may fail to drive a heavy pile satisfactorily. A water jet is sometimes used in sandy soils. Water supplied under pressure at the point of the pile through a pipe or hose run alongside it erodes the soil, allowing the pile to settle into place. To have full capacity, jetted piles are driven after jetting stops.

Piles may obtain their supporting power from friction on the sides or from bearing at the point. In the latter case, the bearing power may be limited by the strength of the pile, considered as a column, to which, however, the surrounding soil affords some lateral support. In the former case, no precise determination of the bearing power can be made. Many formulas have been developed for determining the safe bearing power in terms of the weight of the hammer, the fall and the penetration of the pile per blow, the most generally accepted of which is known as the "Engineering News" formula. This formula and similar ones are based on the determination of the energy in the falling pile hammer head and, from this, the pressure which it must exert on the top of the pile. The piles are then driven to a depth calculated as necessary to give the bearing power for which they were designed.

Concrete piles may be divided into two classes, those which are molded in place and those which are precast, cured and driven. Piles of both types, longer than 100 feet, have been driven. In one well known pile of this type (Raymond), a thin steel sheet is fitted over a tapered mandrel before driving. This shell, which is left in the ground when the mandrel is withdrawn, is filled with concrete. Another well known pile (Simplex) of the molded-in-place type uses a hollow cylindrical mandrel which is filled with concrete after having been driven to the desired depth and raised a few feet at a time, the concrete flowing out of the bottom and filling the hole in the earth. Precast and molded-in-place piles may be reinforced with steel. Only steel-reinforced piles are of interest in this invention. Prestressing of precast concrete piles gives greater assistance to handling and driving stresses. Jetting is used extensively in placing precast concrete piles, but most are driven into place. Jetting is often not practical or safe in city work, because of danger to the foundations of adjoining buildings. Driving by hammer necessitates a cushioned driving head.

Concrete piles are preferably spaced not closer than 3 feet on their centers. If driven closer than this, one pile is liable to force another up. Piles in a group must not cause excessive pressure in the soil below their tips.

After the piles are cut off, either conventionally or in accordance with this invention, they generally are capped with concrete.

The driven concrete piles of this invention are prestressed with steel cables, so that they can withstand the stresses caused by driving, as well as the deadload of the structure the piles support. The prestressing of the concrete is accomplished by stressing the steel between anchorages before casting the pile and then, after the concrete pile has hardened, transferring the load to the concrete by anchoring the ends of the steel in the pile. Very high strength steel bars, wire, or cable are used in order to keep down the space required by, and the weight of, the steel, and to minimize the relative losses in steel stress due to shrinkage and the creep of the concrete upon relaxation of the steel. Frequently 4 steel cables are used in concrete piles, but this number can vary, depending upon the diameter of the pile and the expected bearing load. Generally, the steel is spaced apart four times the diameter of the individual wires or three times the diameter of the strands and at least one and one-third times the maximum size of the concrete aggregate.

In employing steel reinforced concrete piles, there is a continuing problem caused by the differential depths to which the piles can be driven. Thus, for example, two apparently identical piles, driven only 50 feet apart, may have final driven depths which differ by several feet. For this reason, steel reinforced concrete piles are manufactured in standard lengths for a given piling, which length is usually in excess of the expected depth requirement. After the piles are driven, the portions of the pile projecting above the ground are all cut off in the same plane (usually at ground level). With conventional steel reinforced concrete piles, the reinforcing cables or wires, which extend the length of the pile, are several inches below the pile side surfaces. In order to cut such a pile at the desired point, it is necessary to drill through the concrete until a cable or wire is reached, after which the cable is cut with any conventional method. This process must be repeated for each one of the cables, the remaining (concrete) portion of the pile being snapped off with a crane. Piles are usually cut in groups, and on the average, a crew of two requires an eight hour day to cut twelve piles, each having four reinforcing cables. The actual drilling may require as much as fifteen minutes per cable, after which the cable must be cut.

Various means are employed to cut the cables, usually electric arc cutting. Two types of metal cutting allied to welding are frequently used, namely, oxygen cutting and electric arc welding. However, for various reasons, electric arc welding (cutting) is much preferred.

Oxygen cutting is based on the rapid, exothermic oxidation of iron when heated to above 1500° F. in the presence of oxygen. The process is therefore, usable with ferrous metals, especially steel bars and the like. Instead of a welding torch, a cutting torch is applied to the gas hoses, and the oxygen-supply pressure is increased. The tip of the cutting torch contains a ring of small orifices for the preheating flame and a central orifice for the oxygen jet. When the steel is suitably heated, the oxygen is turned on, "burning" a clean, narrow cut as the torch advances. For preheating, oxygen and acetylene are commonly used; other fuel gases are hydrogen, propane, natural gas, etc. The speed of cutting using oxyacetylene varies from about 8 to 12 inches per minute for a manual cut through 1-inch thick steel to about 5 to 7 inches per minute for a manual cut through 2-inch thick steel. Four inch thick steel will cut at about 4 to 5 inches per minute manually.

Arc cutting processes rely on electric arc heat to melt a path through the metal and are, therefore, capable of cutting non-ferrous as well as ferrous metals. As in welding, the arc is established between an electrode forming one terminal of an electric circuit and the workpiece forming the other terminal. The cable being the workpiece, it must be grounded.

Various means are employed to flush out the molten metal from the cut. Any suitable method can be used in cutting pile cables, including air carbon-arc cutting, in which the electrode holder is equipped to direct a jet of compressed air in line with the electrode so as to blow away the molten metal.

The most closely related prior art to this invention known to the inventor is as follows.

U.S. Pat. No. 812,223 discloses reinforced concrete piles in which the cables are held together by ties. The drawing of FIG. 1 and the description on page 1, lines 34–39, clearly indicate that the twist of the ties project inwardly toward the center of the pile.

U.S. Pat. No. 1,257,835 relates to reinforced concrete piles especially designed for use in seawater. FIG. 3 might seem somewhat similar to the present invention, however, study indicates that FIG. 3 is merely an end view of FIG. 1, and indicates that the steel cables taper inwardly toward the center of the pile near the top. The purpose of this inward taper is to put an added concrete layer around the steel cables for corrosion protection. This same purpose is accomplished in FIG. 4 by adding more concrete around the upper portion of the pile.

U.S. Pat. No. 1,165,134 relates to prefabricated reinforced concrete piles which have rods running throughout the entire length as well as tie rods. In none of the piles (see FIG. 4) are there any outwardly projecting tie rods.

U.S. Pat. No. 2,355,190 relates to prestressed reinforced concrete piles. In these piles, the steel reinforcing rods do not go through the entire pile but, instead, end somewhat short of the top. The purpose of this construction is to prevent corrosion by seawater.

U.S. Pat. No. 3,501,920 discloses reinforced concrete piles which are in the form of tubes having a cable spirally wrapped around the tensioned reinforcement cables. From the drawings, particularly FIGS. 2, 3 and 6, it is quite apparent that this idea is not closely related to the present invention.

SUMMARY OF THE INVENTION

This invention relates to improved steel reinforced concrete piles. The improvement is the use of at least one metal rod per reinforcement cable, located in a plane perpendicular to said cable, one end of which is in direct contact with, or very close proximity to, said cable, the other end of which projects outward towards the closest side surface of the pile. It is also contemplated to have more than one rod per cable in a given plane, as well as a plurality of said rods located in parallel planes approximately equidistant from each other along the axis of the cable. Another aspect of this invention, is that there must be one such rod for each reinforcing cable of the pile. Preferably, the rods for the various cables have identical planes, at any given point along the cable axes.

The piles of this invention, which I have named "alpha-omega", are used in the following manner. When it is desired to cut a portion of the invention pile projecting above ground, one need only expose the outward projecting end of one of the rods, using a manual or power hammer. An electric cutting arc is then applied to the exposed end of the rod, and the rod is melted and routed out until the cable is reached. In a continuing operation, the reinforcing cable is then cut. Since this must be repeated for each of the reinforcing cables, it will readily be appreciated why it is desirable to have a rod for each cable in approximately the same plane. Of course, if there is a plurality of rods, such as about one inch apart running along each cable, all of the cables can be severed at about the same length. After all the cables are cut, the projecting end of the pile is broken off using any conventional method. A method often used in practice when severing the prior art piles, such as striking the end with a wrecking ball suspended from a crane, should be satisfactory for the subject invention. It is expected that by using this invention, a one man crew (aided by a crane) can sever the projecting ends of 20 or more steel reinforced concrete piles in an eight-hour day. This not only saves man-hours but, even more importantly, reduces the job completion time and eliminates a potential bottleneck.

DESCRIPTION OF THE PREFERRED EMBODIMENTS

Figure 1:
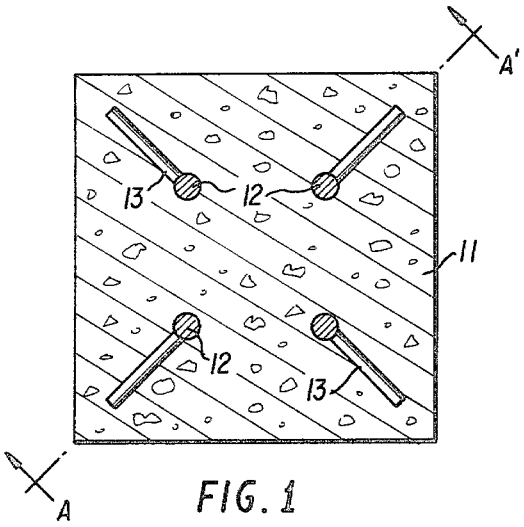
FIG. 1 is an end planar view of a reinforced concrete pile according to this invention.

The improved steel reinforced concrete piles of this invention, and the method of severing the piles according to this invention, depend substantially upon the nature of the rods which are incorporated in the pile and their placement within the pile.

The primary purpose of the rods of this invention is to facilitate exposing the steel reinforcing cables of the pile so that they can more easily be cut at the exposed point, and the pile severed. Thus, the rods afford an access to the cables which is easier to utilize than the conventional method of drilling a hole through the concrete to expose the cable. Since the purpose of the rods is to facilitate access to the cables, and since the cables are normally cut within an electric arc cutter, the rods are preferably composed of an electrically conductive metal that may be routed using the same electric arc cutter. The best metals for such purposes known to the inventor are ferrous metal alloys, although other metal alloys are also contemplated within this invention. It is another embodiment of this invention that the rods be composed of a non-metallic substance that can be easily routed so as to expose the steel tenons.

The diameter of the rods may vary, provided that it is large enough to permit a cutting apparatus to operate upon the steel cable that is exposed when the rods are routed. Ferrous metal rods with a diameter as small as 0.125 inch may be used, although a diameter of at least 0.25 inch is preferred. A rod diameter greater than about 0.5 inch usually affords no increased benefit, unless the cable cutting instrument to be used requires the space for access. Additionally, where weight or structural integrity of the pile dictate, the diameter of the rods should be kept to the smallest size permissible. The length of the rods will vary with each pile, since the rods should be long enough to extend from the cable to within from about 0.5 inch to about 1.5 inch of the pile surface.

The simplest embodiment of this invention would be a concrete pile reinforced by a single cable, in which a single rod had been placed extending outward from the axis of the cable and substantially touching the tenon at the rod's inner end, with the rod's outer end located beneath the outer surface of the pile. This embodiment would permit severing the pile at the point at which the rod was located, using the method of this invention. By chipping away the concrete between the outer end of the rod and the pile surface and routing the rod with an electric or gas arc cutter, access to the cable would be greatly facilitated. The cable could be cut at the exposed point using the same arc in a continuous operation, or in any other conventional manner in a discontinuous operation. The pile would then be snapped at the point where the cable was cut, in the conventional manner.

The other embodiments of this invention are variants of the single rod pile and method, utilizing a plurality of rods. Where the pile has more than one cable, there would have to be at least one rod for each cable, and preferably a set of plural rods for each cable, and the routing method would be duplicated for each rod to be removed, so that each cable is exposed to cutting.

As a practical matter, the use of a single rod per cable would first allow the pile to be severed only at a given point and second make it difficult to locate the point along the outer surface. It is therefore a preferred embodiment of this invention for a plurality of rods to form a set for each cable and to be located along each cable.

As shown in FIG. 1, in a pile 11 having four steel cables 12, the rods 13 should point outward toward the corners of the pile (which are most easily chipped away to expose the outer ends of the rods). Additionally, the rods should be placed so that one rod for each pile will lie within a few inches of a given plane, this plane being the point at which the pile is to be severed.

Figure 3:
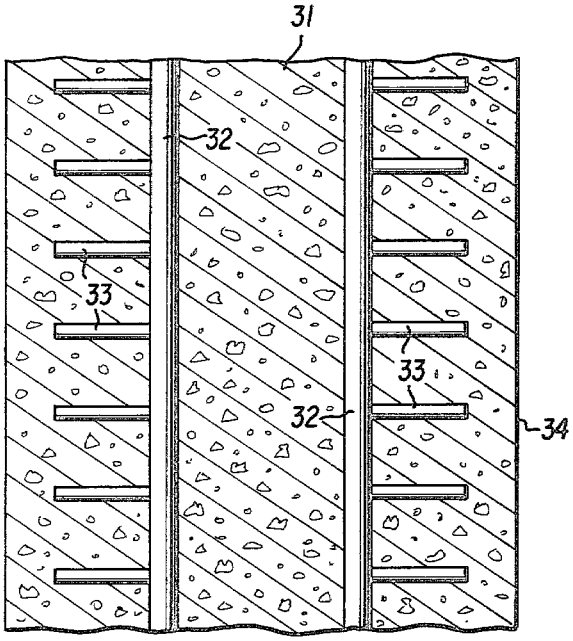
FIG. 3 is a side planar view through line AA' of FIG. 1 of a segment of a reinforced concrete pile according to this invention.

Because of the mass of the concrete piles, and the field conditions under which the piles are severed, a few inches tolerance is permissible in the point at which each of the cables is severed, although ideally they all will be severed in the same plane, perpendicular to the axes of the cables. In order to afford reasonable access to the cables, it is a preferred embodiment of this invention that a plurality of rods be located along each cables, forming a set of rods each of which is spaced approximately at an equidistant interval, and the rods of each set being approximately parallel to each other. FIG. 3 shows an embodiment of this type, taken through ling AA' of FIG. 1, in cross-section. The rods 33 are approximately parallel to each other and at right angles to the axes of the cables 32. The rods 33 substantially touch the cables 32 at the rods' inner ends and point outwards towards the closest corner 34 of the concrete pile 31. The distance of the rods from each other should be about the same for a given pile. This distance is not critical, but if the rods are too close together, the structural integrity of the pile may suffer and if too far apart, the pile may not be severable at a desired point. It is therefore contemplated that the rods be placed from about 1 inch to about 3 inches apart, along a given cable.

Figure 2:
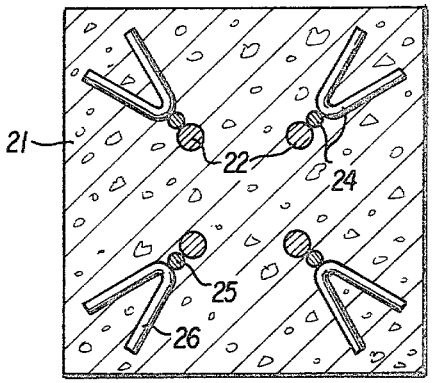
FIG. 2 is an end planar view of another reinforced concrete pile according to this invention.
Figure 6:
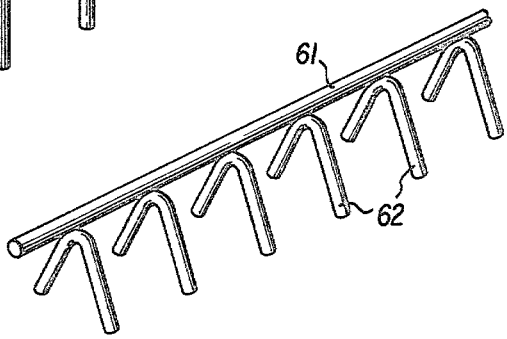
FIG. 6 is a "chair" bar support for reinforcing steel that may be utilized to afford the rods to the reinforced concrete piles of this invention.

Another embodiment of this invention is to use, as a source of the rods, commercially available bar supports for reinforcing steel. Such bar supports (known generally as "chairs" and "ladders") comprise a metal wire rod to which are welded metal wire legs are regular intervals, and when used herein, the legs would form the rods of this invention. FIG. 6 illustrates such a chair in which the metal wire rod 61 is supported by U- or V-shaped legs 62 which are attached to the metal wire rod at their apexes. An end planar view of a pile according to this invention, using the chair of FIG. 6 is shown in FIG. 2. In FIG. 2, a concrete pile 21 having steel cables 22 also contains a chair 24. This chair 24 has a metal wire rod 25 substantially touching the cables 22 at one or more points along their respective lengths and has legs 26 pointed outward, generally toward the corner of the pile. The legs of the chair thus form the rods of this invention.

Figure 4:
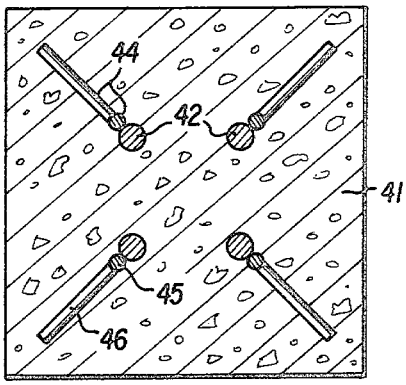
FIG. 4 is an end planar view of another reinforced concrete pile according to this invention.
Figure 5:
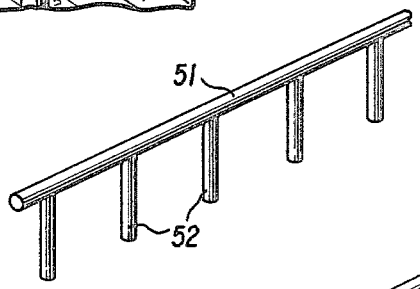
FIG. 5 is a bar support for reinforcing steel that may be utilized to afford the rods to the reinforced concrete piles of this invention.

Another type of bar support for reinforcing steel useful in this invention is a ladder as shown in FIG. 5, in which a metal wire rod 51 is supported by straight legs 52 welded to the metal wire rod. FIG. 4 is an end planar view of a concrete pile according to this invention, in which the bar support of FIG. 5 is utilized. In FIG. 4, a concrete pile 41 having cables 42 also contains bar supports 44. Each bar support 44 has a metal wire rod 45 to which are welded legs 46. The legs 46 form the rods of this invention.

Where bar supports are used, it is necessary only that the metal wire rods be in contact with the steel tenons at some point along the metal wire rod's length, so that an electrical contact can be made if electric arc routing of the rod is to be utilized. The electric arc will be grounded through the end of the tenon in contact with the earth.

It is one embodiment of this invention for the rods to be placed along the entire length of the steel cable.

It is another embodiment of this invention that the rods be spaced along the cable for a distance of up to 15 feet from one or both ends of the pile. This would permit utilization of this invention without using rods in excess, and only in that portion of the pile likely to be severed.

To prove the practicality of the alpha-omega improved concrete pile and method of this invention, a short length of steel reinforced concrete piling was prepared, incorporating the improvement of this invention. A square cross-section wooden mold 8 inches on a side was used, and a pile was prepared having 4 steel cables. A ladder similar to that of FIG. 5 was incorporated for each cable to afford the rods, which were about 3 inches in length and under 0.5 inches in diameter. When the pile was completely cured. the corners were chipped away with a hammer and the ends of the rods were exposed. An electric arc cutter was then successfully used to route the rods so as to give access to the cables. The cables were then cut in a conventional manner using the same electric arc cutter, in a continuing operation.

I claim:

1. In a reinforced concrete pile having a plurality of steel reinforcing cables, the improvement comprising the presence of at least one ferrous metal alloy electrically conductive rod per cable, said rod being perpendicular to, and projecting outward from, the axis of the cable, the inner end of each said rod being in substantial electrical contact with said cable, the outer end of each said rod projecting outward to within 0.5 to 1.5 inches beneath the surface of the pile.

2. The improved pile of claim 1 wherein there is a plurality of rods forming a set for each cable, the rods of each set being substantially parallel and equidistant from each other and spaced not less than about 1 inch apart, the outer ends of such rods projecting toward the nearest corner or surface of the pile.

3. The improved pile of claim 2 wherein the rods are afforded by a chair or ladder incorporated within the pile, said chair or ladder comprising a ferrous metal alloy wire rod and legs attached thereto, and wherein said wire rod is substantially in electrical contact with the cable at some point along its length, there being one such chair or ladder for each tenon.

4. The improved pile of claim 3 wherein the rods are afforded by a ladder.

5. The improved pile of claim 3 wherein the rods are afforded by a chair.

6. The improved pile of claim 2 wherein the rods of each set are spaced along its cable for a distance of not more than 15 feet from at least one end of said pile.

7. The improved pile of claim 2, 3 or 6 wherein there are at least 4 steel cables.

* * * * *